US006523601B1

(12) United States Patent
Hury et al.

(10) Patent No.: US 6,523,601 B1
(45) Date of Patent: Feb. 25, 2003

(54) METHOD AND APPARATUS FOR IMPROVING INTERNAL QUALITY OF CONTINUOUSLY CAST STEEL SECTIONS

(76) Inventors: Shlomo Hury, 38 Amy Court, Woodcliff Lake, NJ (US) 07677; Samuel Kayam, 227 Thornberry Cir., Pittsburgh, PA (US) 15234; Philip E. Ponikvar, Pine Valley Rd., Bridgeville, PA (US) 15017; Boris Buziashvili, 411 E. 82nd St., Apt #2A, New York, NY (US) 10028

( * ) Notice: Subject to any disclaimer, the term of this patent is extended or adjusted under 35 U.S.C. 154(b) by 0 days.

(21) Appl. No.: 09/944,427

(22) Filed: Aug. 31, 2001

(51) Int. Cl.[7] ..... B22D 11/04; B22D 11/12

(52) U.S. Cl. ..... 164/416; 164/417; 164/441

(58) Field of Search ..... 164/426, 478, 164/416, 437, 488, 260, 417, 441

(56) References Cited

U.S. PATENT DOCUMENTS

| | | | | |
|---|---|---|---|---|
| 3,415,306 A | | 12/1968 | Olsson | 164/478 |
| 4,016,926 A | * | 4/1977 | Yamada et al. | 164/147.1 |
| 4,373,950 A | | 2/1983 | Shingu et al. | 164/71.1 |
| 4,457,356 A | | 7/1984 | Hasebe et al. | 164/478 |
| 4,498,518 A | | 2/1985 | Hasebe et al. | 164/416 |
| 4,564,059 A | | 1/1986 | Dobatkin et al. | 164/478 |
| 4,573,515 A | * | 3/1986 | Kitamura et al. | 164/468 |
| 4,590,986 A | | 5/1986 | Scholz et al. | 164/448 |
| 4,662,427 A | | 5/1987 | Larrecq et al. | 164/416 |
| 4,691,757 A | | 9/1987 | Polanschutz et al. | 164/416 |
| 4,694,886 A | | 9/1987 | Sakaguchi | 164/416 |
| 4,716,955 A | | 1/1988 | Fastert | 164/475 |
| 4,730,667 A | * | 3/1988 | Chevion | 165/84 |
| 5,186,236 A | | 2/1993 | Gabathuler et al. | 164/478 |
| 5,355,935 A | | 10/1994 | Nogues | 164/416 |
| 5,542,466 A | | 8/1996 | Bruckner et al. | 164/478 |
| 5,584,338 A | | 12/1996 | Freeman et al. | 164/478 |
| 5,799,722 A | | 9/1998 | Buziashvilli et al. | 164/478 |

FOREIGN PATENT DOCUMENTS

| | | |
|---|---|---|
| DE | 28 05 277 | 8/1979 |
| JP | 54-15424 | 2/1979 |
| SU | 1792796 | 2/1993 |

* cited by examiner

*Primary Examiner*—Tom Dunn
*Assistant Examiner*—I.-H. Lin
(74) *Attorney, Agent, or Firm*—Clifford A. Poff

(57) ABSTRACT

Segregation of carbon or alloying elements in a solidifying liquid core during casting of a continuous metal strand of high carbon steel or alloy steel, are disbursed by vibrating hammers engaged with a solidified shell enclosing a liquid steel core. The hammers are located before the end of the liquid core. A vibrator operating at a frequency of between 1000 and 5000 cycles per minute is coupled to the hammers by a support structure forming a dead weight mass for maintaining a metal-to-metal contact with the solidified shell while vibrated by the vibrator. The support structure is guided for stabilizing the hammers and for displacement of the hammers between an operative position and inoperative position.

7 Claims, 8 Drawing Sheets

METHOD AND APPARATUS FOR IMPROVING INTERNAL QUALITY OF CONTINUOUSLY CAST STEEL SECTIONS

CROSS-REFERENCE TO RELATED APPLICATIONS

Not applicable

BACKGROUND OF THE INVENTION

1. Field of the invention

The present invention relates to a method and an apparatus to improve the internal quality of a continuously cast steel section and, more particularly, to mechanically vibrate a solidified shell of such a steel section at a site upstream of the end of a contained liquid steel core consisting of high carbon steel or alloy steel to reduce segregation by dispersing carbon or alloying elements during final solidification of the liquid core.

2. Description of the Prior Art

Inherent internal conditions in the process of continuous casting of steel sections such as billets, blooms, rounds and slabs have a significant influence on the internal quality of the steel section especially when casting high carbon steel and alloy steel. The inherent conditions are center looseness, center segregation, and equiaxed grain ratio. While center looseness and center segregation are not desirable, obtaining an equiaxed grain ratio is very desirable. Several methods of combating or enhancing the above mentioned conditions are known to produce a varying degree of success. Two such known methods are electromagnetic stirring and soft reduction. Electromagnetic stirring is accomplished by applying a magnetic field to the cast section liquid core to agitate the steel causing the breakage of the dendrite tips and dispersion of inclusions. This action promotes recrystallization in the solidification process and minimizes center segregation. The soft reduction method involves progressively squeezing a mushy zone in the solidifying section to refine the grain size at the center of the section, which also influences center segregation and center looseness. Electromagnetic stirring and soft reduction methods are capital intensive, when initially installing the necessary equipment into a new facility or when retrofitting the necessary equipment into an existing facility.

It is an object of the present invention to provide a method and an apparatus to introduce vibration by physically impacting a continuously cast section at a location before final solidification.

It is a further object of the present invention to provide a method and an apparatus to apply mechanical vibrations to an outer shell of a continuously cast section to vibrate an internal mushy zone sufficiently to cause the breakage of dendrite tips and thereby promote recrystallization and to enhance refinement of the grain structure by dispersion of segregated carbon or alloying elements, to produce an equiaxed and dense structure, and to reduce porosity by facilitating the floatation of gas bubbles to the top of the mold.

SUMMARY OF THE INVENTION

According to the present invention there is provided an apparatus for reducing segregation in a solidifying section with a contained liquid core during casting of a continuous metal strand of high carbon steel or alloy steel, the apparatus including the combination of at least one hammer having a face surface for engaging a solidified shell enclosing a liquid steel core having concentrations of carbon or alloying elements, a vibrator having an operating frequency of between 1000 and 6000 cycles per minute coupled to the hammer for vibrating the liquid core to disperse concentrations of carbon or alloying elements during solidification of the liquid core, a dead weight mass mechanically coupled to the hammer for maintaining a desired contact force on the solidified shell by the hammer while vibrated by the vibrator, and guides for stabilizing the hammer.

The present invention further provides a method for reducing segregation in a solidifying liquid core during casting of a continuous metal strand of high carbon steel or alloy steel, the method including the steps of, selecting a site along a cast strand upstream of the end of a liquid core contained within a solidified shell of a continuous casting installation for high carbon steel or alloy steel, and vibrating the solidified shell at the site at a frequency selected to disperse concentrations of carbon or alloying elements during solidification of the liquid core to refine the grain structure during solidification of the liquid core. Preferably, the solidified shell is vibrated at a frequency of between 1000 and 6000 cycles per minute.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
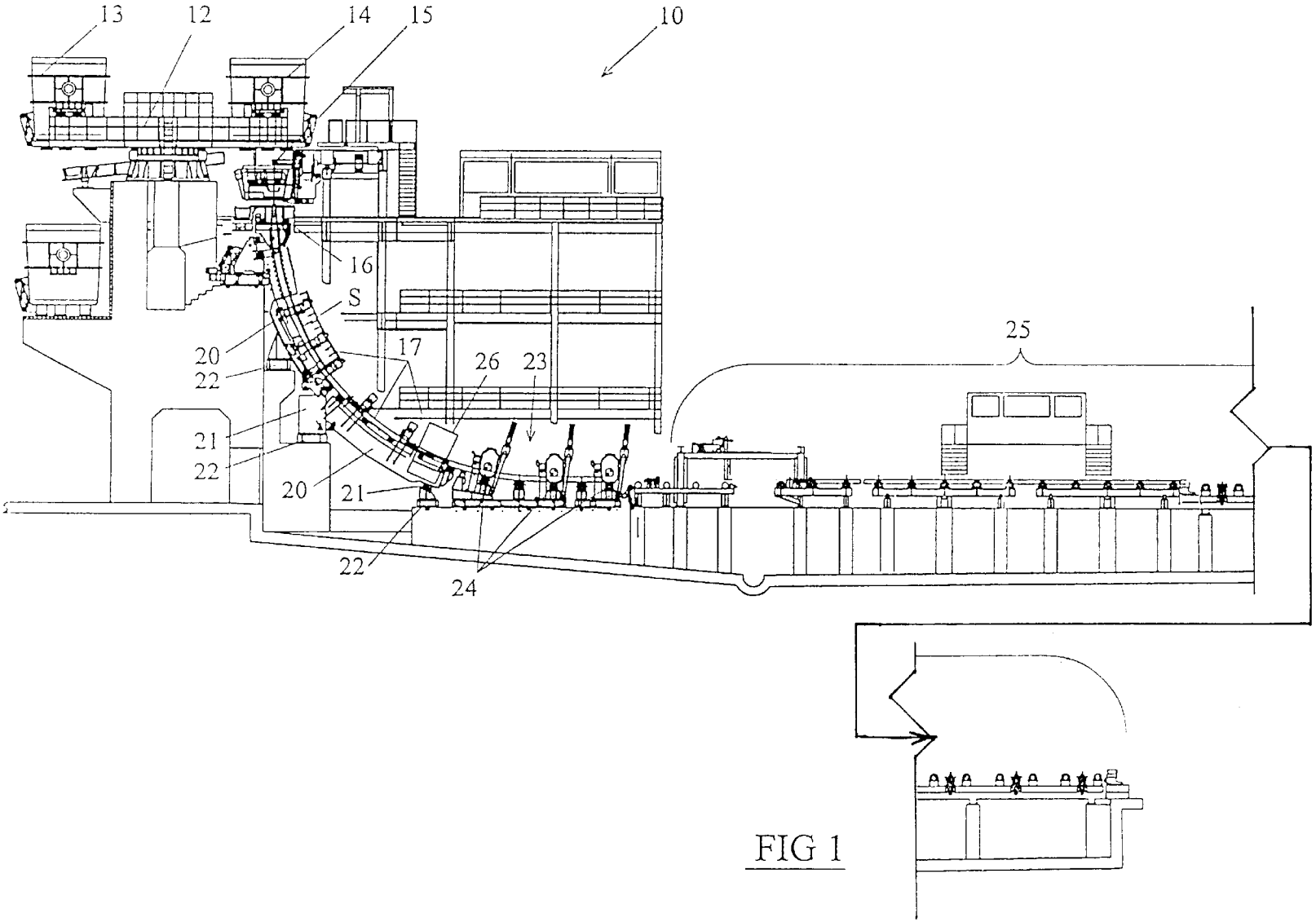
FIG. 1 is an elevational view of a continuous casting installation embodying the present invention.
Figure 2:
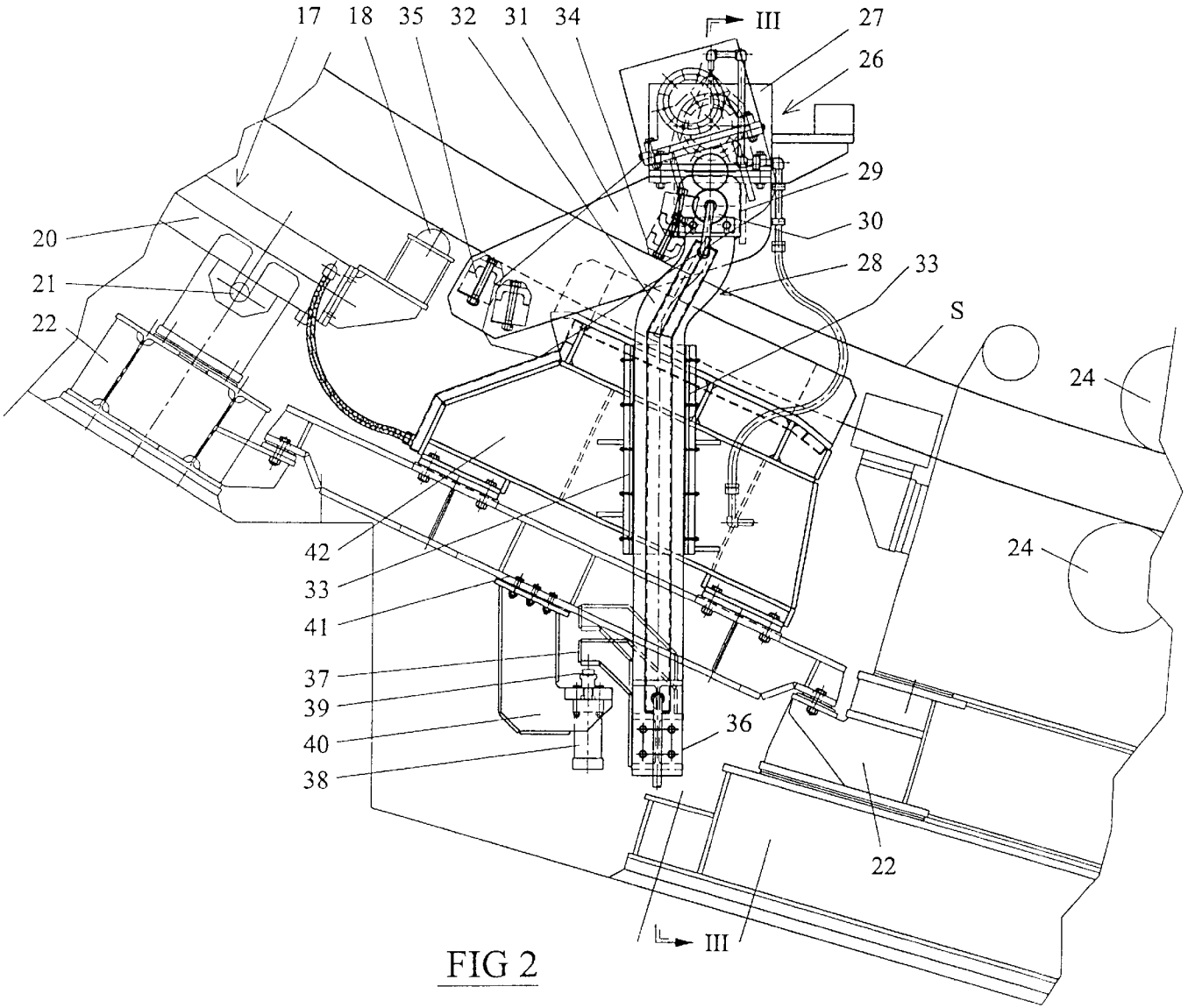
FIG. 2 is an enlarged elevational view of an apparatus to vibrate a newly formed continuously cast strand at a site along a secondary cooling section of a continuous casting installation as shown in FIG. 1.

FIGS. 1 and 2 illustrate one form of a continuous casting installation 10 suitable to practice the method and incorporates one embodiment of the apparatus according to the present invention to produce a continuously steel casting comprised of high carbon steel or alloy steel. The term high carbon steel is defined to mean carbon steel with a carbon content of 0.45% or greater and the term alloy steel is defined to mean an alloyed steel having enhanced properties by the presence of one or more special alloying elements or due to the presence of larger portions of elements such as manganese and silicon than are ordinarily present in carbon steel. The continuous casting installation 10 includes a ladle turret 12 for delivering molten steel in ladles 13 and 14 into and from a position directly above a tundish 15. The tundish delivers a stream of liquid steel into a water-cooled mold 16 and a continuous strand S made up of a solidified shell surrounding a liquid core passes from the mold along a curved secondary cooling section 17. The continuous strand S has a well-known cross sectional configuration such as a billet, a bloom, a round or a slab. The secondary cooling section 17 contains spaced apart guide rollers 18 interleaved with water spray headers, not shown, to continue the cooling process. Preferably, though not necessary, mold 16 also includes an electromagnetic coil assembly 19 to provide electromagnetic stirring of the liquid core in the continuous strand S. The rollers and spray headers of the secondary cooling section 17 are supported by consecutively arranged frames 20, each having anchor rods 21 supported on pedestals 22 mounted on an underlying foundation. The secondary cooling section extends to a straightener section 23 provided with motor driven straightenering rolls 24 for straightenering and delivering the continuous strand S to a runout table 25.

In accordance with the present invention there is provided an apparatus 26 to vibrate the continuous strand S in the continuous casting installation 10 at selected site upstream of the end of the liquid core within the solidified shell. The end of the liquid core is generally within or close to the straightener section 23. The selected site in the embodiment shown in FIGS. 1 and 2 is in a gap that exists between the last of the guide rollers 18 of the secondary cooling section 17 and the first pair of motor driven straightener rolls 24 of a straightener section 23. The selected site can be located in a space between driven straightener rolls 24, or past the last pair of straightener rolls and before the point of solidification of the liquid core.

Figure 3:
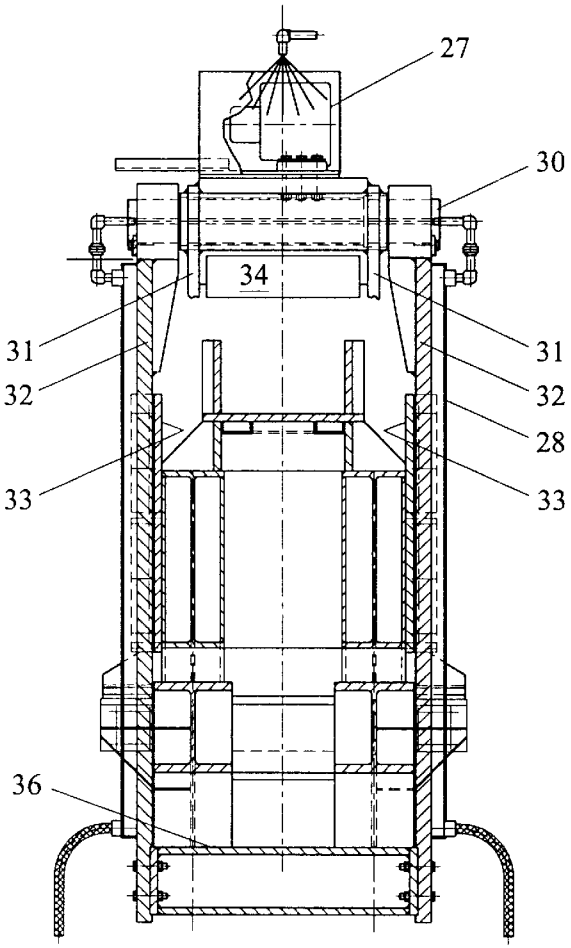
FIG. 3 is a sectional view taken along lines III—III of FIG. 2.

As shown in FIGS. 2 and 3, the apparatus 26 essentially includes an oscillating dead weight mass, driven by a vibration actuator 27 which can be electromagnetic or eccentrically driven by an air, hydraulic, or electric motor. The vibration actuator 27 is mounted on a vibrating head 29, which pivots on a frame 28, and is engaged and disengaged by a linear actuator retained at the selected site through the use of supporting structure provided by the existing foundation of the casting machine. However, the selected site may be located in an area behind, i.e. downstream of, the straightener rolls in the event that the liquid core extends into this area. When engaged and activated, the mass undergoing oscillation is comprised of the frame 28 and the vibrating head 29 will undergo dynamic impacting with the continuous strand S at a preselected and relatively low frequency typically at a frequency in the range of 1000 to 6000 cycles per minute, preferably in the range of 3000 to 4000 cycles per minute. The magnitude of the dead-weight mass required for static contact with the continuous strand S, the oscillation stroke and force of the vibration actuator 27 are chosen relative to the physical dimensions of the continuous strand S. The oscillation cycle, stroke and force are controllable parameters of the vibration actuator 27. The construction of the frame 28 and vibrating head 29 are specifically engineered to establish a predetermined dead weight required for exerting contact forces by hammer face surfaces on the casting. A plate P may be added to support a counterweight W to modify the dead weight and center of gravity of head 29, such modification to the center of gravity to compensate a change to the metallurgical composition of the continuous strand or a change to the thickness of the continuously cast strand. However, it is to be understood that the hanging weight of the dead weight mass and the center of gravity can be modified by the addition of weight to the cross head 36 and/or by the counterweight W. The vibrations generated by the vibration actuator 27 are transmitted from the vibrating head 29 by a shaft 30 to the frame 28. The shaft 30 pivotally interconnects head 29 with spaced apart rails 32 of frame 28 extending along opposite sides of the of the continuous strand S where the rails slidably engage with guides 33 extending generally vertically for stabilizing the frame 28. The link arms 31 extend from the shaft 30 in a cantilevered fashion along opposite sides of the continuous strand S for rigidly mounting the opposite ends of two hammers 34 and 35 in a spaced apart relation to thereby mechanically couple the hammers to the vibration actuator 27. The hammers 34 and 35 have face surfaces arranged for engaging the upwardly and downwardly directed face surfaces of the continuously moving steel casting. It is sufficient to provide at least one hammer although two hammers are preferred. The vibration imparted to the hammers serves the additional and essential function of reducing friction between the hammers and the continuously moving steel casting which allows unimpeded forward movement of the casting without damage to the hammer support structure including the guides 33.

The lower end portions of the spaced apart rails 32 are secured to a cross head 36 provided with an arm 37 having a lateral projection overlying a linear actuator 38 which can be electrically, pneumatically or hydraulically powered to displace an actuator rod 39. The actuator is supported by a bracket 40 extending from the underside of a frame 41, which extends in the direction of the flow of the casting for support by adjacent pedestals 22 at the boundaries of the gap at the selected site. The frame 41 includes upstanding frame 42, which includes the guides 33 for supporting the rails 32. Channels, one of which is identified by reference numeral 43, for coolant water are strategically placed at diverse locations to cool the apparatus 26 during the operation of the continuous casting installation 10.

Figure 6:
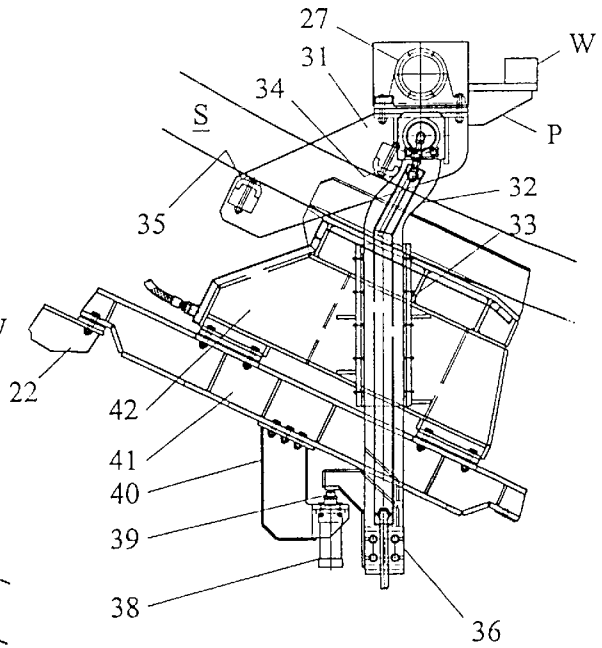
FIGS. 4, 5 and 6 are schematic illustrations of the transition of the apparatus to vibrate the casting between an inoperative position and an operative position.
Figure 5:
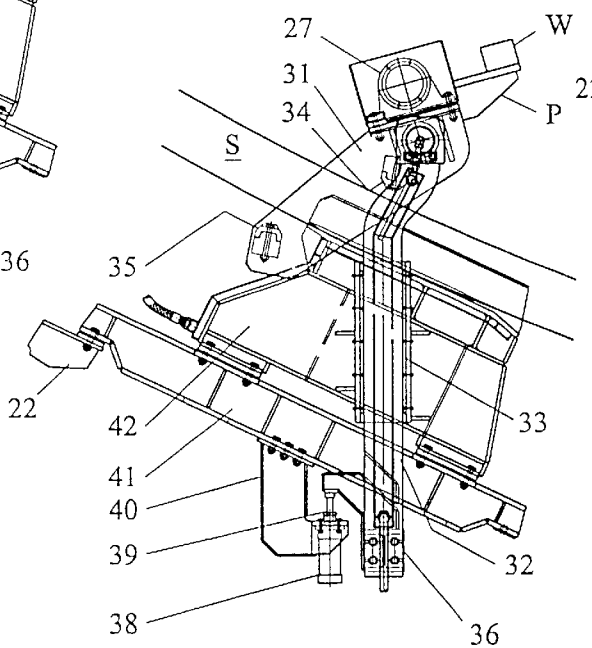
Figure 4:
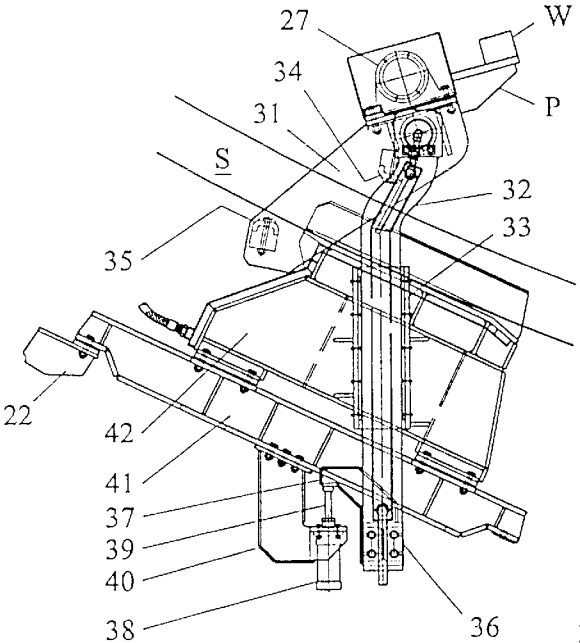

As shown in FIG. 4, the actuator rod 39 of the linear actuator 38 is extended to hold the upper hammer 34 in an inoperative position at a location above the casting. The cantilevered relation of the hammers relative to the shaft 30 allows the lower hammer 35 to rotate to an inoperative position below the casting by rotation of the link arms 31 about the shaft 30 and the upper hammer 34 to rotate to an inoperative position above the casting. The apparatus 26 is moved into an operative position by retracting the actuator rod 39 and, as shown in FIG. 5, this allows downward travel of the rails 32 along the guides 33 with the receding movement by the actuator rod. The upper hammer 34 rotate to an operative position contacting the upper surface of the casting S and the lower hammer rotates toward an operative position for contact with the lower surface of the casting S. When the actuator rod 39 is fully retracted, as shown in FIG. 6, the upper hammer 34 remains in contacts the upper surface of the casting and the lower hammer 35 pivots about shaft 30 into contact with the lower surface of the casting. The dead-weight mass of the assembly, which moved to allow contact with the casting by the two hammers, establishes a metal-to-metal contact with the casting under a dead-weight load. At the position shown in FIG. 6, the actuator rod 39 is disengaged with arm 37 and thereby the entire weight of the head 29 and the frame 28 is hanging on the strand S.

Figure 7:
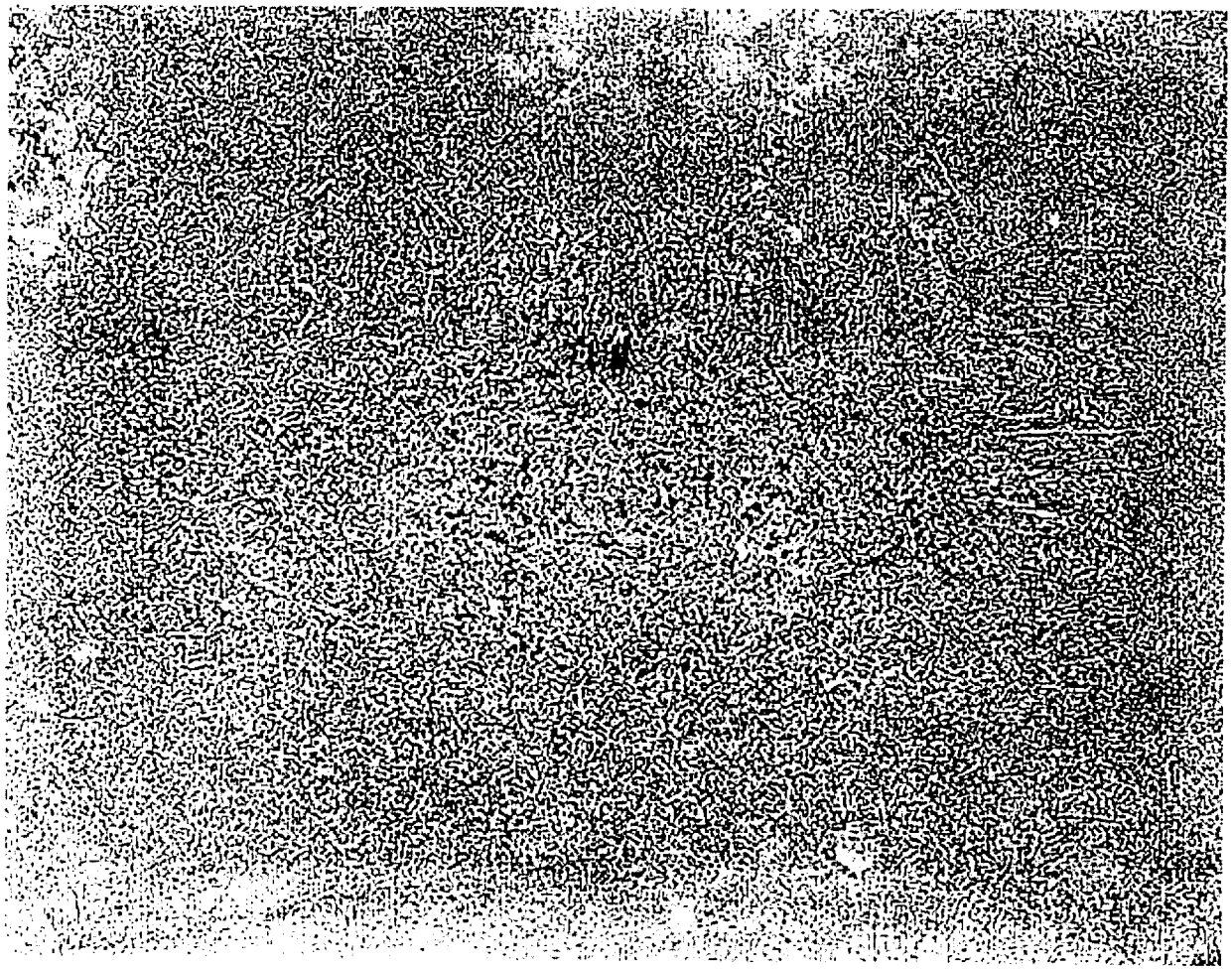
FIG. 7 is a photograph of a cross section of a high carbon continuous steel casting produced by an ordinary or standard casting method.
Figure 8:
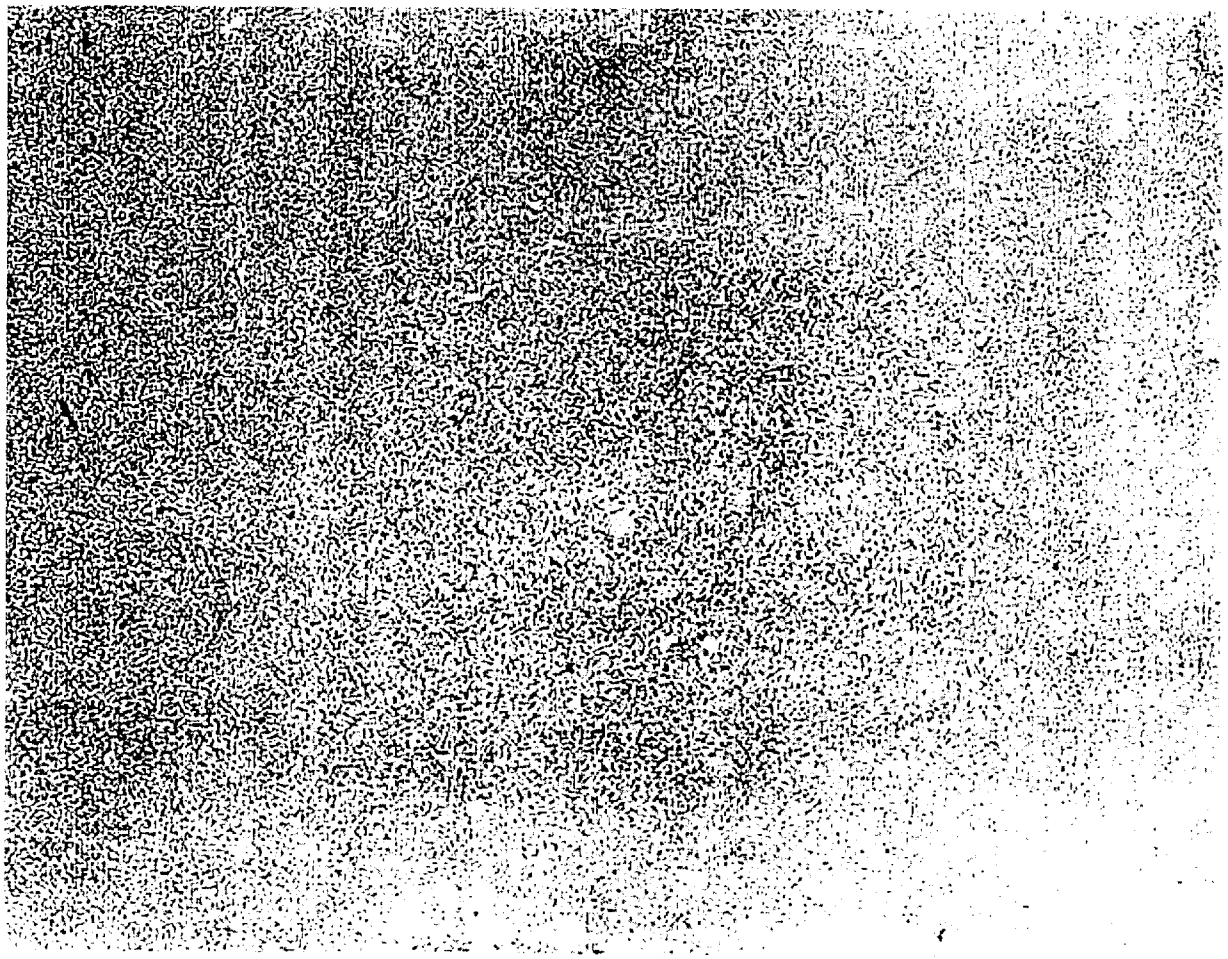
FIG. 8 is a photograph of a cross section of a high carbon continuous steel casting produced by a modified casting method incorporating the present invention.

The vibration imparted to the steel shell propagates to the internal liquid core and in directions of toward the mold and oppositely to essentially the end of the liquid core to disperse concentrations of carbon or alloying elements occurring in the continuous casting of high carbon steel or alloy steel, respectively. FIG. 7 illustrates extensive center segregation of the grain structure in a continuous strand produced without practicing the method or use of the apparatus of the present invention. FIG. 8 illustrates a very favorable refined central grain structure in a continuous strand S produced by the same casting machine used to produce the steel casting of FIG. 7 but modified by practicing the method and the use of the apparatus of the present invention. The absence of voids in the central area of the casting shown in FIG. 8 is a note worthy advancement as compared with high concentrations of voids and segregated grain structure visible in the cross section of FIG. 7.

Figure 9:
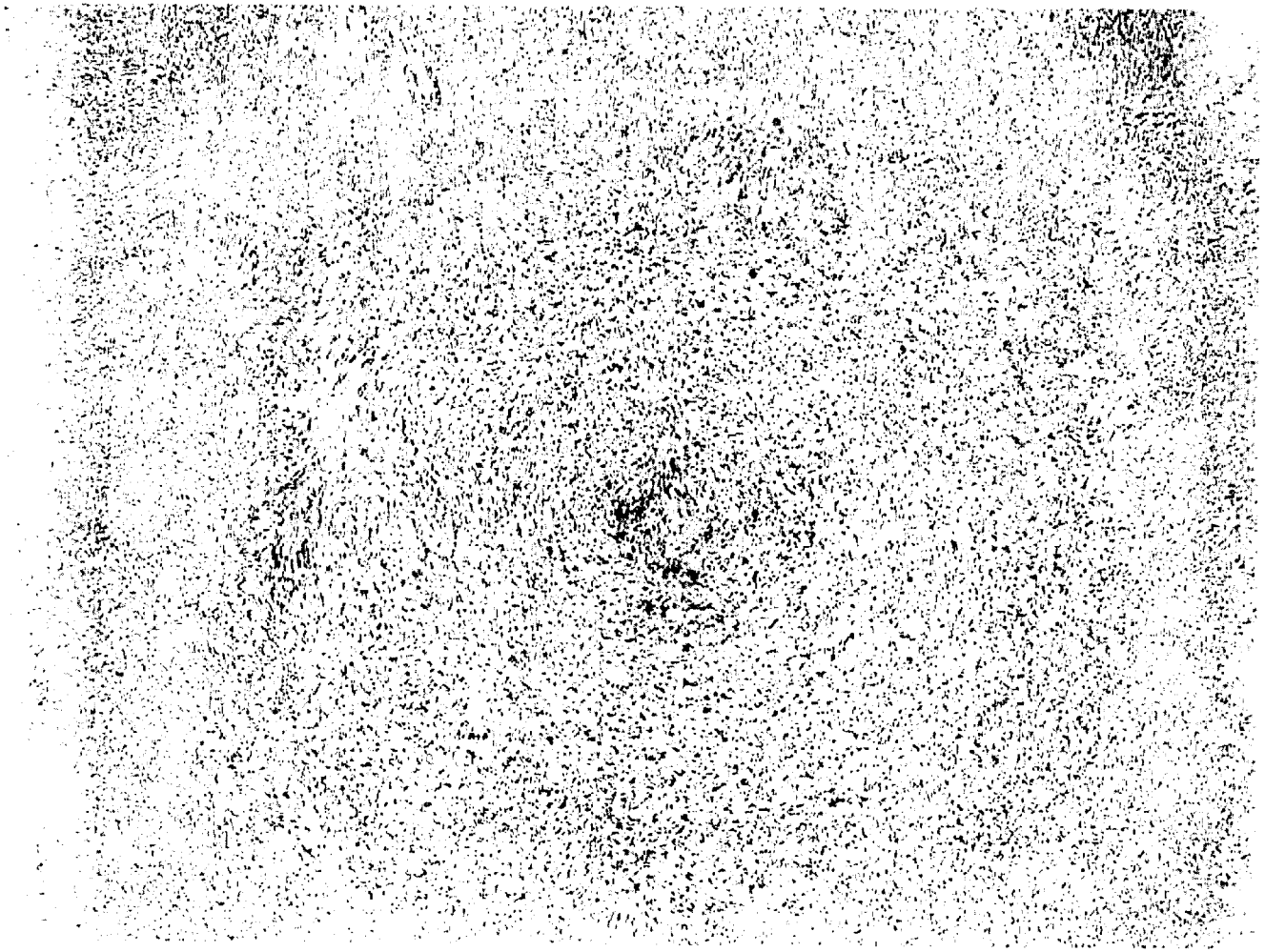
FIG. 9 is a photograph of a cross section of a high carbon continuous steel casting produced by an ordinary casting method with electromagnetic stirring.
Figure 10:
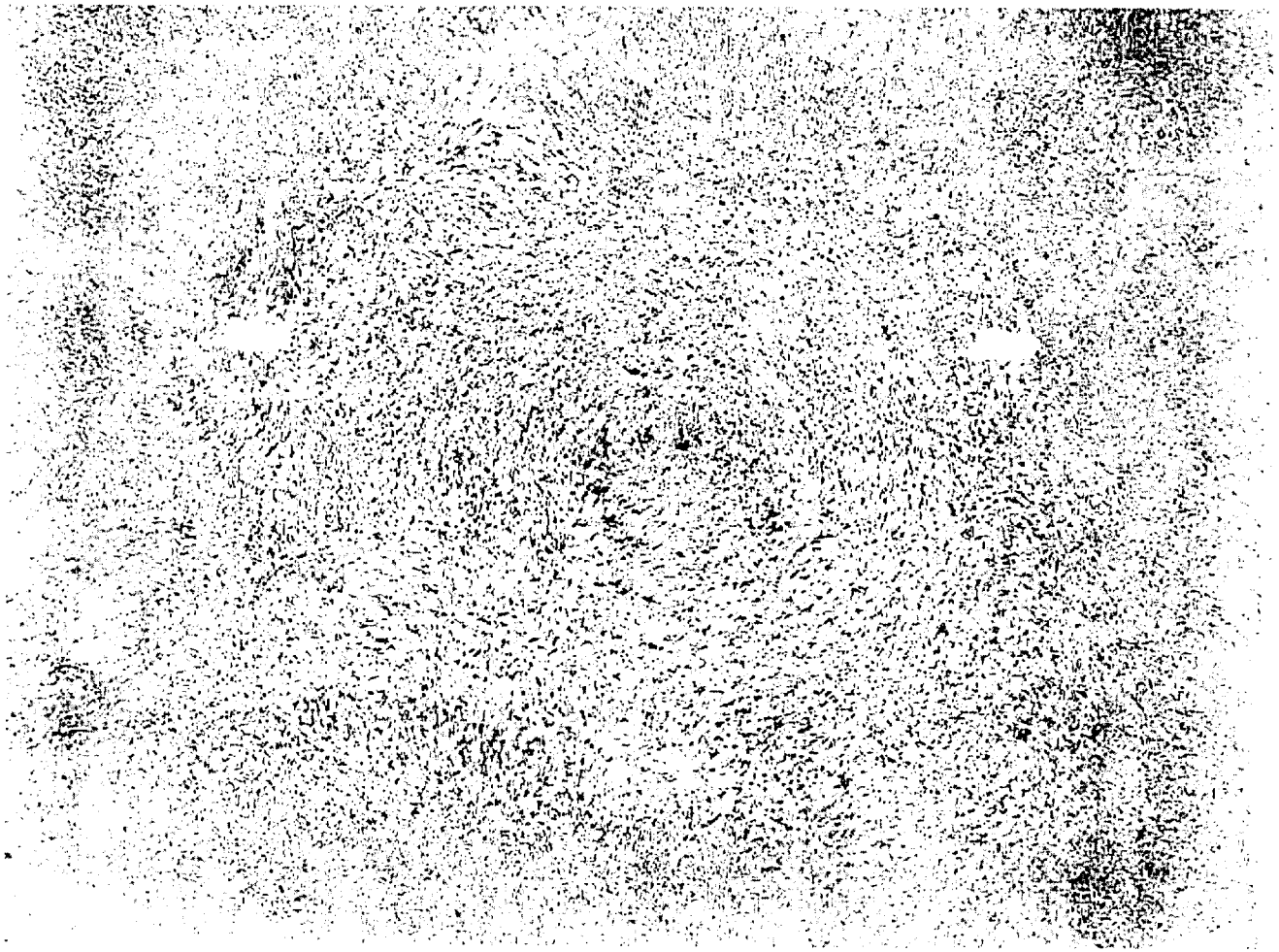
FIG. 10 is a photograph of a cross section of a high carbon continuous steel casting produced by a modified casting method incorporating the present invention combined with electromagnetic molds stirring.

Experimental use of the present invention further included a trial to examine the benefits of vibrating the casting in a continuous casting machine equipped with electromagnetic stirring of the steel residing in the mold which produced the equiaxed and densely refined grain structure as shown in FIG. 9. The operation of the continuous casting installation was altered by placing the apparatus to vibrate the casting in the inoperative position but use of the electromagnetic stirring was continued to recover a casting and examine the grain structure, which is shown in FIG. 10. The benefits of breaking dendrite tips during cooling of the central core of the high carbon steel or alloy steel are readily apparent which also was found to accelerate the solidification process by the seeding of the liquid core with the broken dendrite tips. Additionally, vibrating the continuously cast strand promoted the discharge of gas bubbles from the core during solidification.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

What is claimed is:

1. Apparatus for reducing segregation in a solidifying section with contained a liquid core during casting of a continuous metal strand of high carbon steel or alloy steel, said apparatus including the combination of:

at least one hammer having a face surface for engaging at least one face surface of a solidified shell enclosing a steel liquid core having concentrations of carbon or alloying elements;

a vibrator having an operating frequency of between 1000 and 5000 cycles per minute coupled to said hammer for vibrating said liquid core to disperse concentrations of carbon or alloying elements during solidification of said liquid core;

a dead weight mass mechanically coupled to said hammer for maintaining a desired contact force on said solidified shell by said hammer while said hammer and dead weight mass are vibrated by said vibrator; and guides for stabilizing said hammer.

2. The apparatus according to claim 1 wherein said at least one hammer includes two hammers each having face surfaces for engaging opposed surfaces of said solidified shell, and wherein said apparatus further includes link arms interconnecting opposed ends of said two hammers for mechanically coupling said vibrator and said dead weight mass to said two hammers.

3. The apparatus according to claim 2 further including an actuator for displacing said hammers between an operating position wherein said two hammers contact said solidified shell and an inoperative position wherein said two hammers are remote to said solidified shell.

4. The apparatus according to claim 2 further including a shaft for pivotally interconnecting said link arms with said dead weight mass.

5. The apparatus according to claim 4 further including a platform including weights for modifying said dead weight mass.

6. The apparatus according to claim 4 wherein said dead weight mass includes a cross head secured to terminal end portions of spaced apart rails extending along opposite sides of said solidified shell and secured by said shaft to said link arms.

7. The apparatus according to claim 6 wherein said guides extend generally vertically and slidably support said spaced apart rails.

* * * * *